United States Patent [19]

Gath

[11] 4,147,338

[45] Apr. 3, 1979

[54] METHOD AND APPARATUS FOR MANUFACTURING CONTINUOUS FORM SETS

[76] Inventor: Karl H. Gath, Weinbergstrasse 35, D-3221 Rollinghausen, Fed. Rep. of Germany

[21] Appl. No.: 588,825

[22] Filed: Jun. 20, 1975

[30] Foreign Application Priority Data

Jun. 25, 1974 [DE] Fed. Rep. of Germany ..... 2430429

[51] Int. Cl.[2] ..... B41L 43/12

[52] U.S. Cl. ..... 270/37; 270/53

[58] Field of Search ..... 270/52, 32, 39–40, 270/5, 10, 41, 37, 20–21, 53

[56] References Cited

U.S. PATENT DOCUMENTS

| | | | |
|---|---|---|---|
| 1,385,569 | 7/1921 | Mayer | 270/40 |
| 1,489,833 | 4/1924 | Keller | 270/39 |
| 2,625,391 | 1/1953 | Jensen | 270/39 |
| 3,143,342 | 8/1964 | Pine | 270/52.5 |
| 3,665,817 | 5/1972 | Katz | 270/37 |
| 3,727,908 | 4/1973 | Whitesell | 270/39 |
| 3,734,487 | 5/1973 | Treff | 270/52 |

*Primary Examiner*—Edgar S. Burr
*Assistant Examiner*—A. J. Heinz
*Attorney, Agent, or Firm*—Bacon & Thomas

[57] ABSTRACT

A machine for making forms sets comprising a continuous bottom sheet and multiple continuous form sheets, includes a central row of assembly stations on either side of which are provided form set sheet supply rolls and form set sheet processing equipment for enabling uninterrupted feeding of bottom and form set sheets to the machine while the form set sheets are processed and assembled to the bottom sheets of the form set. The upper form sheets are fed continuously to the assembly station using a special arrangement of feed and guide rollers, each successive set of form sheets being fed from alternate sides of the assembly station. Assembled form sets are finally perforated, folded and stacked in a desired manner by the machine.

1 Claim, 6 Drawing Figures

METHOD AND APPARATUS FOR MANUFACTURING CONTINUOUS FORM SETS

BACKGROUND OF THE INVENTION

This invention relates generally to a high speed apparatus for making continuous form sets, one form of such apparatus being shown in my co-pending application Ser. No. 418,934 filed Nov. 26, 1973, now U.S. Pat. No. 3,937,452. The present improvement relates to a means for making form sets having continuous bottom and form set sheets wherein all the sheets are processed and assembled in a continuous manner, preferably without a dwell or rest period for the bottom sheet as the form sets are assembled in the machine. This enables the machine to operate at high processing speeds and results in a machine that is extremely compact and efficient. Machine of this general type are known in the prior art, as shown, for example in U.S. Pat. No. 2,228,419 to Stern. However, the present invention is intended to produce superior results at high rates of production using an improved machine that is able to operate without interruption of the feeding of any of the sheets of the form set.

SUMMARY OF THE INVENTION

Continuous series of linearly attached form sets comprising a continuous bottom sheet and one or more continuous series of linearly attached form set sheets overlying the bottom sheets are processed, printed, adhesively prepared, assembled and perforated in a continuous, high speed manner from supply rolls of indeterminate length using a machine of the general type shown in my U.S. application Ser. No. 418,934, filed Nov. 26, 1973, now U.S. Pat. No. 3,937,452, to which reference is hereby made for various detailed descriptions of the basic machine.

The present invention is a further refinement of the basic machine shown in that application, and utilizes means for continuously feeding processed (prepared) form set sheets (webs) of indeterminate length (continuous) to assembly stations spaced along the machine in generally the same manner as illustrated in my earlier application, whereby the form set sheets, which may be supplied as single or multiple webs, can be assembled to a continuous bottom sheet web. The assembly process comprises bringing the various webs together in registry to make the complete form set, and adhesively bonding or otherwise securing the upper form set sheets to each other and to the bottom sheets when they are brought together in overlying relationship at an assembly station. The adhesive securing of sheets, of course, may be between the bottom sheet and the next adjacent form set sheet or may be between individual form set sheets themselves.

In accordance with the present invention, a central row of assembly stations along which a bottom sheet is continuously or intermittently advanced is provided on either side thereof with multiple form set sheet supply and processing stations that are in staggered relationship to each other along the central assembly stations. Each form set supply and processing station includes one or more supply rolls of form set webs that are continuously unwound at controlled speeds, printed in any desired manner, adhesively prepared if bonding is to be used to secure the form set sheets together, preferably by applying a predetermined pattern of glue dots to the webs, and fed to an assembly station, (in registered arrangement with the other form set webs at the respective supply station if more than one upper form set web is being fed to the respective assembly station).

The bottom sheet width and form set sheet width are all predetermined to result in the production of the desired form set width when the sheets are assembled. A set of feed and guide rollers at each assembly station enables the form set sheets to be continuously fed to the assembly station and assembled without interrupting the form set sheet feed or the bottom sheet feed. Alternatively, the feed of all sheets may be intermittent to permit interleaving of individual form set sheets at desired assembly stations in accordance with the teaching of my prior application named above.

The assembled form sets are perforated widthwise, folded and stacked in the machine in a generally conventional manner.

As indicated above, an alternate embodiment of the invention comprises the use of an intermittent feed rate with respect to the bottom sheet of the form set in the manner taught by my earlier application. In this embodiment, the assembly of combined individual form set sheets to a continuous bottom sheet and the incorporating of one or more continuous sheets into the form set using the presently described apparatus is enabled.

DETAILED DESCRIPTION OF THE INVENTION

With reference to the attached drawings.

Figure 1:
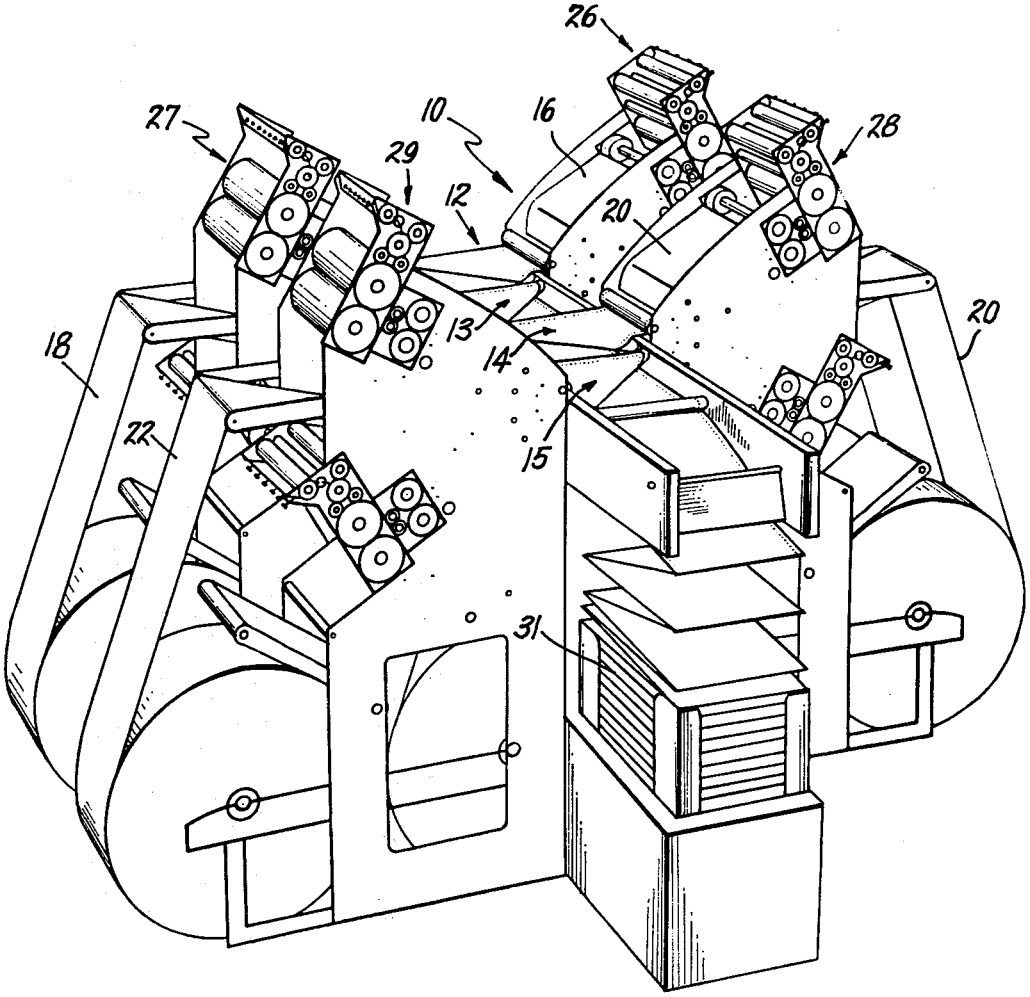
FIG. 1 is a perspective view of the overall machine embodying my invention.

With reference to the attached drawings, in FIG. 1 there is illustrated one embodiment of a machine constructed in accordance with my invention, the machine being generally indicated by the reference numeral 10. A central row of assembly stations 12, 13, 14 and 15 is shown wherein continuous form set sheets 16–22 (see FIG. 3) are assembled to a bottom sheet 25 when the bottom sheet is not supplied from one of the assembly stations.

The central row of assembly stations is provided on either side thereof with staggered form set sheet supply and processing stations generally indicated at 26, 27, 28 and 29. The supply and processing stations are arranged in staggered relationship with respect to each other on either side of the central row of assembly stations, whereby an extremely compact arrangement may be obtained for the continuous manufacture of form set sheet assemblies.

Figure 4:
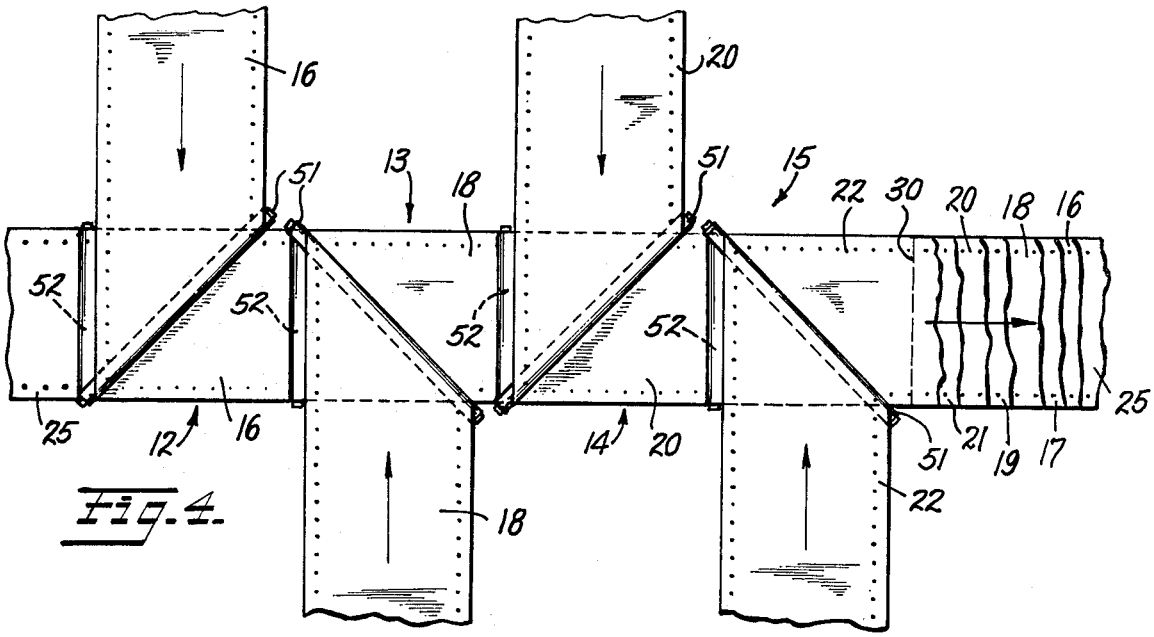
FIG. 4 is a diagrammatic illustration of a row of assembly stations, showing how the form set guide rollers are oriented.

After the form sets are assembled, they may be provided with tear line perforations shown at 30 in FIG. 4. At predetermined intervals the sheets preferably are folded along the line 30 and stacked in a receiver 31 in the machine.

Figure 2:
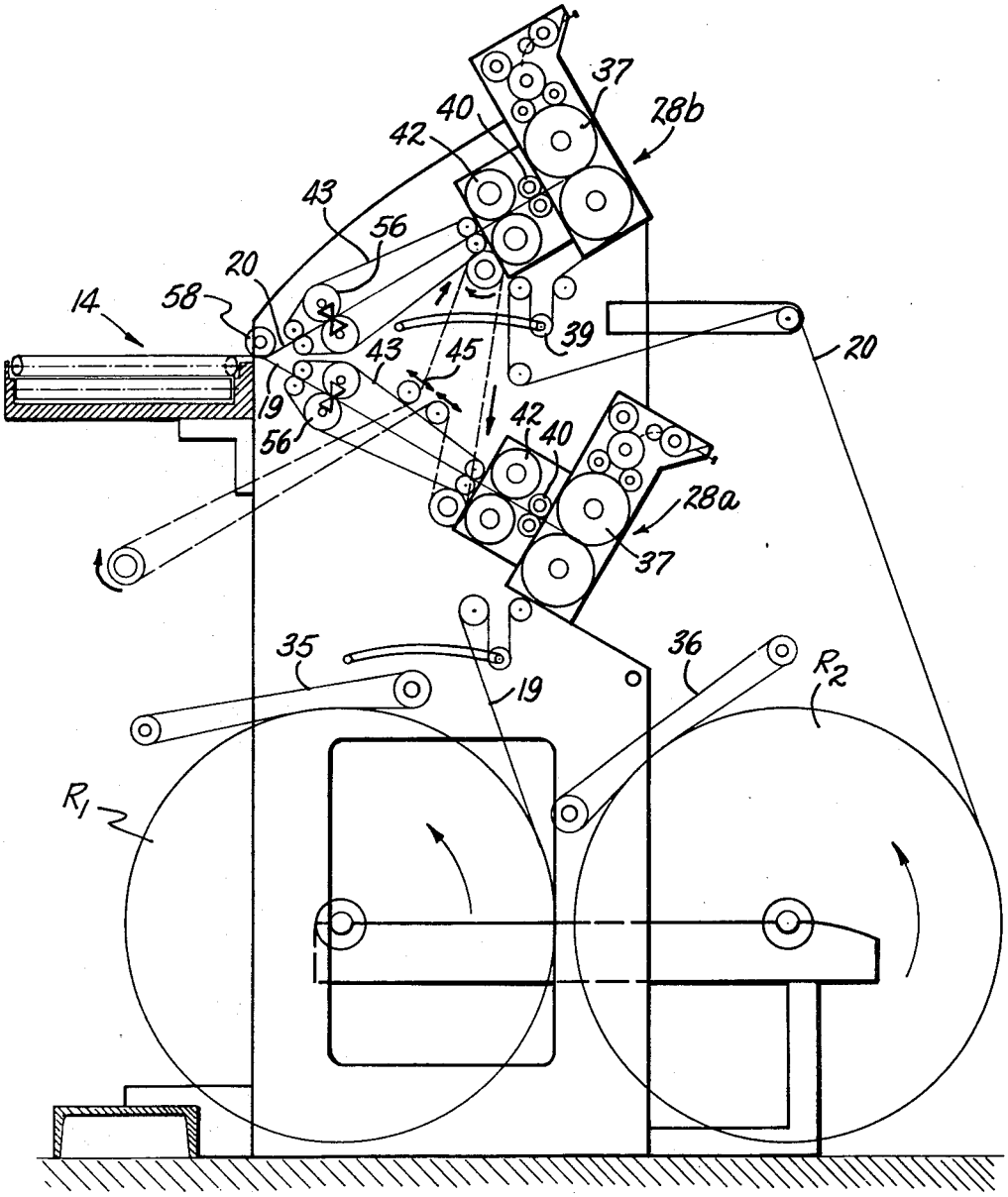
FIG. 2 is a diagrammatic view of a typical form set sheet supply and processing station of the machine.

In FIG. 2 there is illustrated a typical form set sheet supply and processing station wherein, for example, sheets 19 and 20 are shown being supplied from rolls $R_1$, $R_2$. Both $R_1$, $R_2$ are driven by drive belts 35, 36 in a generally conventional manner, while webs 19, 20 are fed to their respective processors generally indicated at 28*a*, 28*b*. In this instance, since a pair of form set sheets 19, 20 are being supplied, a pair of processors 28*a*, 28*b* are provided to perform the desired operation on each of the form set sheet webs 19, 20.

Each of the processors 28*a*, 28*b* typically include a printing cylinder 37 and its associated apparatus along with a web tension control means in the form of a dancer roll 39; a set of web feed rolls 40; rotary hole punching means 42; and web feed belts 43 that are synchronized through a drive chain system 45 that enables accurate feeding in synchronism of both webs 19 and 20 as they are fed to the assembly station 14.

In FIG. 2, one or the other of the supply rolls $R_1$, $R_2$ may be selectively deenergized and web processing stopped to enable any of the supply and processing stations 26–29 to alternatively feed one or two form set sheets to each assembly station.

Figure 5:
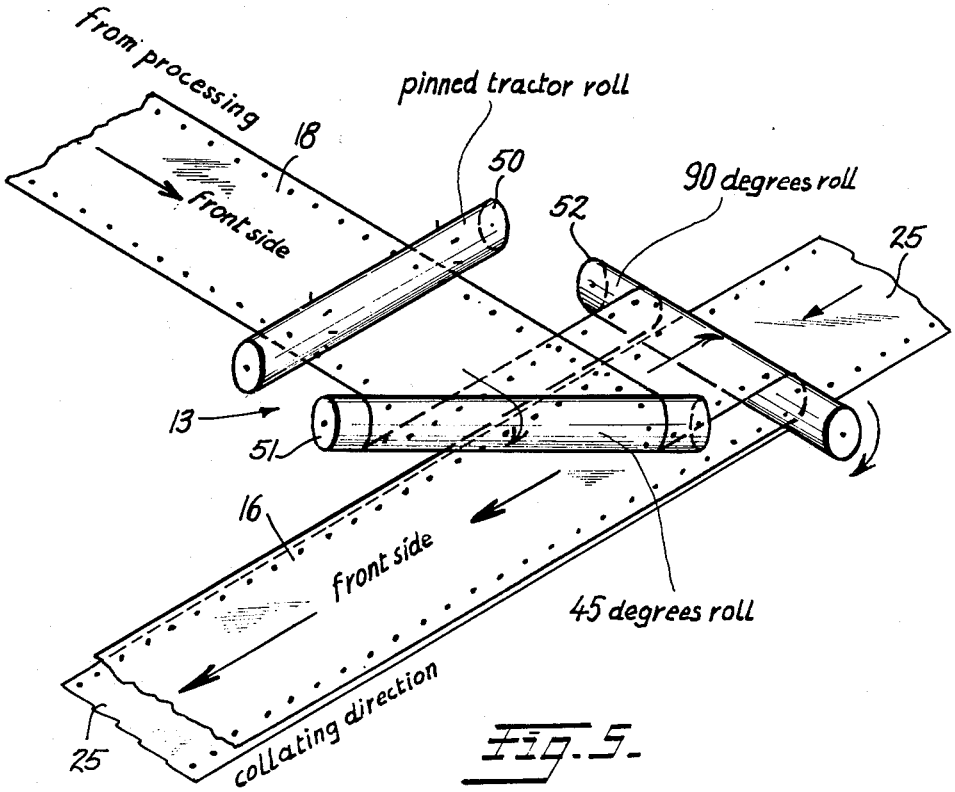
FIG. 5 is a diagrammatic illustration of how a typical set of feed and guide rollers are disposed at an assembly station.

As shown in FIG. 5, each assembly station includes a set of guide rollers for feeding the form set sheets singly or in pairs (or other multiples, if desired) whereby the direction of travel of the form set sheets is changed from a transverse direction to a longitudinal direction parallel to the bottom sheet 25 and in registered arrangement with respect thereto. In FIG. 5, assembly station 13 is illustrated to show the guide rollers 50, 51 and 52 changing the infeed direction of processed form sheet 18 so that the latter overlies and is in registry with bottom sheet 25 which passes beneath the rollers at the assembly station.

Figure 3:
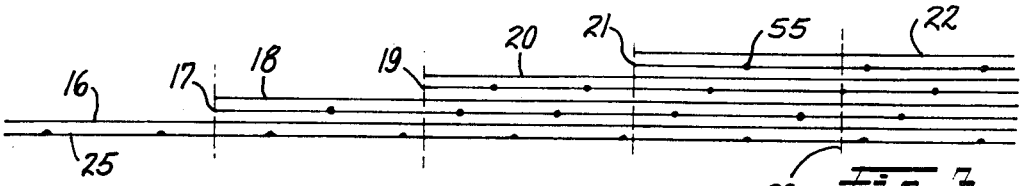
FIG. 3 is a diagrammatic view of how typical form sets are assembled.

As shown in FIGS. 3 and 4, a single form set sheet 16 is supplied to assembly station 12 while the bottom sheet 25 is continuously fed through the assembly stations 12–15. At assembly station 13, a pair of previously processed form set sheets are supplied to overlie the sheets 25 and 16. At assembly station 14, form set sheets 19 and 20 are supplied, as are sheets 21 and 22 at assembly station 15. All the sheets are moved continuously, without interruption, in accordance with the preferred embodiment of this invention whereby the form set sheets 16–22 may all be processed in a continuous, uninterrupted manner and fed to the assembly stations, 12, 13, 14 and 15 for assembly to the bottom sheet 25 while the bottom sheet is continuously moved through the assembly station.

Of course, it will be apparent also that in use, the sheet 16 that is fed to the first assembly station 12 could be used as a bottom sheet and sheet 25, along with its processing and supply station, could be omitted if desired. Likewise, if a pair of sheets 16 is supplied at station 12 in a manner similar to the sheets supplied at stations 13–15, the bottom one of the pair of sheets at station 12 could comprise "a bottom sheet." Obviously, the term "bottom sheet" must be interpreted in this description as that sheet that is on the bottom of the final form set, whatever its supply source is, whether it be from the roll 25 or the sheet 16 or another "bottom" sheet supplied at the station 12.

In an alternate embodiment, not illustrated, the drive system for advancing the processed form set sheets may be intermittent in operation for enabling their assembly to an intermittently moving bottom sheet 25 in the manner described in my previous application identified above. With this arrangement, a continuous bottom sheet 25 may have secured thereto one or more individual form set sheets as described in my earlier application and one or more continuous form set sheets secured to and overlying the individual form set sheets that have been previously assembled to the bottom sheet. With this arrangement, one or more assembly stations as illustrated in my earlier application with respective form set sheet supply stations also as described therein may be combined with the means recited herein for supplying continuous form set sheets, the respective assembly stations of either type being arranged in series or in alternate arrangement, depending on the particular type of form set desired. It is further contemplated that a suitable drive system can be provided to enable uninterrupted movement of the form set sheet supply rolls $R_1$, $R_2$ and continuous processing of the continuous form set sheets even when they are supplied to the assembly station with an intermittent feed, including the stationary dwell time to accommodate the assembly stations that may be included in the system in which individual form set sheets are being assembled in the form set.

As indicated in FIG. 3, the glue dots 55 that have been applied to the sheets 16–22 are preferably arranged in staggered relationship between sheets to avoid undesirable thickness build-up in the area of the glue dots as the thickness of the sheet increases and also to prevent adverse effects of the glue dots between the sheets themselves. The glue dots 55 may be applied by means of dispenser means 56 shown in FIG. 2. A pinned traction drive roll 50 pulls the processed form set sheets from the processing stations 28*a*, 28*b*.

Figure 6:
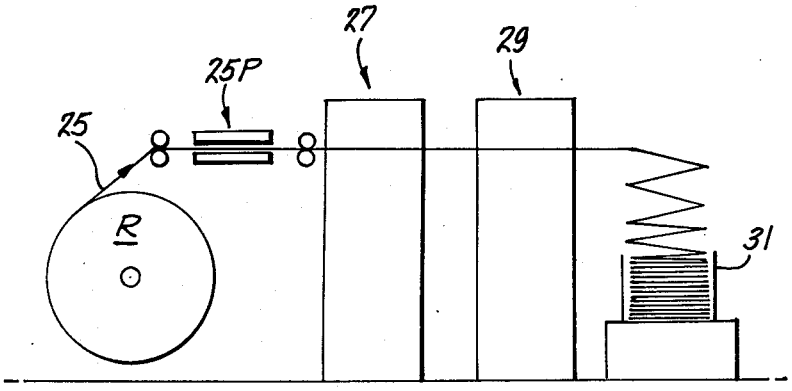
FIG. 6 is a diagrammatic illustration of a bottom sheet feed and processor.

As shown in FIG. 6, a bottom sheet 25 may be fed from web roll R through bottom sheet processor 25P.

It will be appreciated that the present apparatus provides an extremely compact machine with a very short length of web material exposed to the atmosphere. Such an arrangement alleviates many of the problems previously associated in apparatus of this general type which utilized equipment requiring long stands of form set web material that were adversely effected by various temperature and humidity conditions surrounding the machine.

It is to be understood that the form set sheets may comprise so-called "carbonless" copy paper or may even include webs of carbon paper interleaved between sheets of normal paper stock.

The above description of a preferred embodiment is by way of illustration only and the present invention is intended to be limited only by the scope of the claims recited below.

I claim:

1. The apparatus for making continuous, linearly attached form sets comprising:

(a) means for supplying and processing multiple, continuous, linearly attached bottom form sheets;

(b) a plurality of longitudinally spaced form set assembly stations;

(c) means for advancing said bottom form sheets sequentially longitudinally through said assembly stations;

(d) a form set sheet supply and processing station laterally and closely adjacent each of said assembly stations, each supply and processing station including means for supplying, processing and feeding continuous, linearly attached form set sheets to each respective assembly station in a direction laterally normal to said bottom sheet advancement direction, at least one of said form set sheet supply stations including means for supplying, processing and feeding registered multiples of form set sheets to the respective assembly station;

(e) guide roller means disposed immediately above each assembly station for receiving and changing the direction of feed of said processed form sheets from a lateral direction relative to the assembly station to a longitudinal direction parallel to and overlying said bottom sheets, with said form set sheets lying contiguous to the underlying bottom sheets and the previously assembled form set sheets, said guide roller means including a first 45° idler roller for changing the lateral feed direction of said form set sheets to a direction longitudinally rearwardly with respect to the advancement direction of said bottom sheets, and a second idler roller over which said form set sheets pass for changing the direction of travel of said form set sheets from a longitudinally rearward to a longitudinally forward direction parallel to and overlying said bottom sheets; and (f) means for causing securement of said form set sheets to and in registry with said bottom sheets and to each other whereby successive form set sheets are progressively attached to and in registry with individual bottom sheets and form set sheets previously assembled to the bottom sheets that are advanced successively through said assembly stations, said means for causing securement of said form set sheets to each other and to said bottom sheets comprising glue dots applied to opposite surfaces of suitable form set sheets in said form set sheet supplying processing stations, said glue dots being diposed in staggered relationship between sheets to avoid thickness build-up in the areas of the glue dots in the final form set, the adhesive bonding between form set sheets and underlying sheets occurring at least in part at each assembly station.

* * * * *

UNITED STATES PATENT OFFICE

CERTIFICATE OF CORRECTION

Patent No. 4,147,338 Dated April 3, 1979

Inventor(s) KARL HEINZ GATH

It is certified that error appears in the above-identified patent and that said Letters Patent are hereby corrected as shown below:

In Figure 2, the reference numeral 58 should be 50.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*